United States Patent [19]

Daeuble et al.

[11] 4,252,531

[45] Feb. 24, 1981

[54] PROCESS FOR DYEING WOOL OR NYLON FIBERS

[75] Inventors: Manfred Daeuble, Frankenthal; Volkmar Weberndoerfer, Mannheim; Hans G. Schulze, Ludwigshafen, all of Fed. Rep. of Germany

[73] Assignee: BASF Aktiengesellschaft, Fed. Rep. of Germany

[21] Appl. No.: 14,820

[22] Filed: Feb. 26, 1979

[30] Foreign Application Priority Data

Mar. 20, 1978 [DE] Fed. Rep. of Germany ..... 2812039

[51] Int. Cl.[3] ..... D06P 3/82

[52] U.S. Cl. ..... 8/531; 8/582; 8/604; 8/917; 8/924

[58] Field of Search ..... 8/21 B, 54, 172 R, 92, 8/531, 582, 604, 917, 924

[56] References Cited

U.S. PATENT DOCUMENTS 3,975,515 8/1976 Wajaroff et al. ..... 8/10.2
3,980,428 9/1976 Fabbri et al. ..... 8/92
4,168,142 9/1979 Hervot et al. ..... 8/101

FOREIGN PATENT DOCUMENTS 846332 3/1977 Belgium .
716990 10/1954 United Kingdom .

OTHER PUBLICATIONS

Hannay; R. J. and Major; W. H., J. Soc. Dyers and Colourists, 1953, 69, pp. 195–200.

*Primary Examiner*—A. Lionel Clingman
*Attorney, Agent, or Firm*—Keil & Witherspoon

[57] ABSTRACT

A process for dyeing textile materials, consisting of wool or nylon fibers, with anionic dyes in an aqueous liquor at up to 110° C., wherein dyeing is commenced at a pH of from 7 to 9 and from 0.2 to 5 parts by weight, per 1,000 parts by weight of liquor, of an ester of a saturated $C_2$–$C_4$-carboxylic acid with an alcohol having a tertiary amino group in the 2-position are added at the dyeing temperature to act as a pH regulator.

7 Claims, No Drawings

PROCESS FOR DYEING WOOL OR NYLON FIBERS

The present invention relates to a process for dyeing wool and/or nylon fibers with anionic dyes in an aqueous liquor at up to 110° C. in the presence of a pH regulator, with or without other conventional dyeing assistants, dyeing being commenced at a pH of from 7 to 9.

To achieve level dyeing it is important that the dyes should be taken up uniformly, as otherwise the dyeings must be levelled out, and this entails additional costs. In the dyeing of anionic dyes on polyamide fibers there is usually controlled heating of the liquor. Control is frequently effected by means of suitable instruments, giving better levelling than manual control, which entails a number of risks. It is true that even the best temperature control cannot exclude all possibility of the liquor heated in the heating unit contacting the goods with varying intensity because of the liquor circulating unevenly in the dyeing unit, for rheological reasons. This is especially the case with large carpet winch vats and with flock dyeing machines using large packages. In those zones of the goods through which the liquor flows preferentially the shade is deeper than where the flow is less and hence heating-up occurs more slowly. It is therefore necessary to heat up the liquor slowly so that the temperature differences in the dyeing machine do not become excessive and cause unevenness that can no longer be levelled even by prolonged heating in the liquor.

However, slow heating has the consequence that the dyeing time is increased and the dyeing capacity reduced. Another problem is that the individual dyes are absorbed in different temperature ranges. Unless the rate of heating is carefully controlled in all temperature ranges in which the components of a dye combination are absorbed, one dye may become unevenly absorbed whilst the other dyes are taken up uniformly. This causes unevenness in shade, which the eye detects much more readily than unevenness in depth of color.

The absorption of dyes on fibers of natural polyamide or nylon can also be controlled by varying the pH of the dye liquor. At each pH of the liquor, a distribution equilibrium between the fibers and the liquor is set up for the particular system. At low pH, this equilibrium is substantially in favor of the fibers and hence the dye is absorbed completely. At higher pH, the equilibrium is increasingly shifted in favor of the liquor and the dye is no longer absorbed on the fibers. This equilibrium is reached more rapidly at higher temperatures, but when dyeing wool, the temperature should not exceed 105° C. since the fibers will otherwise suffer irreversible damage. The distribution equilibrium between the fibers and the liquor depends on the pH and is a parameter specific to each system. Dyes of relatively low molecular weight, which in general give dyeings of relatively low wetfastness, are dyed in a more strongly acid liquor than dyes of relatively high molecular weight, which give dyeings of greater wetfastness. In the case of particularly wetfast dyes, eg. milling dyes for dyeing wool, the initial dye strike is carried out in an almost neutral liquor, and the liquor is then acidified with acetic acid or formic acid so that the incompletely absorbed dye can become completely absorbed on the fibers.

German Laid-Open Application DOS No. 2,700,153 discloses a process for dyeing textile material, in which the pH is reduced during dyeing by controlled addition of inorganic acids to the dyeing liquor. This process has the disadvantage that the liquor always has a relatively low pH in the zones where the acid is introduced. Those portions of the goods which first come into contact with this liquor are, at any particular point in time, exposed to a lower pH than other portions which the liquor only reaches later.

If, for example, the liquor flows through a cheese, a sliver bobbin or a beam, the portions which the liquor reaches first will always exhibit a somewhat lower pH than those at which the liquor leaves the package and is returned, by means of the pump, to the point at which the acid is added. The conditions in winch vats are particularly ill-defined, because the liquor flow through the goods being dyed is barely foreseeable, even if liquor circulation is provided. It will therefore readily be seen that this metered addition of acid always entails risks, so that non-uniformity remains a possibility.

British Pat. No. 716,990 discloses the use of esters of organic acids as pH regulators when dyeing wool or nylon fibers with anionic dyes. The dyeing liquor is first brought to a pH above 8. An organic ester is then added and the liquor is heated to the boil, which causes the ester to hydrolyze and gradually reduces the pH of the liquor to a value of about 6.5. The dyes are taken up slowly so that particularly level dyeing and complete penetration are achieved.

German Laid-Open Application DOS No. 2,354,728 discloses the use of a lactone, especially of butyrolactone, as a pH regulator when dyeing textile materials consisting of natural polyamides or nylons.

According to the process disclosed in German Laid-Open Application DOS No. 2,542,926, nylon velour material is dyed by first bringing the pH of the liquor to a value of 7.8–8.5, then heating the liquor to 70°–100° C. and introducing the goods into the heated liquor. Dyes, and mono-esters of glycols or of glycol derivatives to act as pH regulators, are then added to the liquor. The hydrolysis of the glycol mono-ester gradually lowers the pH of the dye liquor to 6.5, so that the dyes are slowly and evenly absorbed.

The disadvantage of the conventional processes in which pH regulators are used is that small amounts of dye remain in the liquor. This is particularly troublesome when dyeing materials in dark shades because the residual dye passes into the effluent. The present invention therefore seeks to provide a dyeing process, using a pH regulator, by means of which better bath exhaustion is achieved.

According to the present invention there is provided a process for dyeing a textile material consisting of wool and/or of nylon fibers with an anionic dye in an aqueous liquor at up to 110° C., wherein dyeing is commenced at a pH of from 7 to 9 and from 0.2 to 5 parts by weight, per 1,000 parts by weight of liquor, of an ester of a saturated $C_2$–$C_4$-carboxylic acid with an alcohol having a tertiary amino group in the 2-position to a hydroxy group are then added to act as a pH regulator.

The acid component in the ester to be used as pH regulator according to the invention is a saturated carboxylic acid of 2 to 4 carbon atoms, for example acetic acid, propionic acid, n-butyric acid and iso-butyric acid and halogen derivatives of these, eg. monochloroacetic acid, dichloroacetic acid, trichloroacetic acid or the corresponding bromoacetic acids.

The alcohol component in the ester to be used as pH regulator according to the invention is an alcohol which has a tertiary amino nitrogen atom in the 2-position to a primary, secondary or tertiary OH group, eg. triethanolamine and the compound of the formula

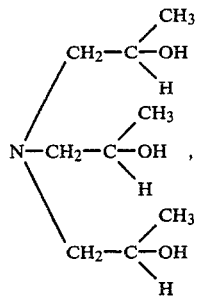

which is obtained, for example, by reaction of ammonia with propylene oxide. Other suitable alcohol components in the esters to be used as pH regulators according to the invention are the reaction products of ethylenediamine, diethylenetetramine, propylenediamine or other polyamines with ethylene oxide or propylene oxide. The reaction of the said amines with ethylene oxide or propylene oxide is carried out in the presence of a Lewis acid as the catalyst. These reactions are to be found in the prior art, and do not therefore require more detailed discussion here. The esters may also be prepared in the conventional manner by esterifying the alcohol, containing a tertiary nitrogen atom, with one of the above carboxylic acids or a derivative thereof, eg. an anhydride or acid chloride or, in the case of acetic acid, ketene.

The preferred pH regulator according to the invention is triethanolamine triacetate. It is not absolutely essential to employ a triethanolamine which has been 100% esterified, but a degree of esterification of about 80% suffices to give an effective pH regulator.

The process according to the invention is used for dyeing wool and/or nylon fibers. Such materials are commercially available and are prepared, for example, by polymerizing caprolactam or by condensing hexamethylenediamine with adipic acid. The goods to be dyed may be, for example, in the form of flock, woven fabric, knitted fabric or yarn in cheese form. Particularly good effects are obtained if wool or nylon velour is introduced into a dyeing liquor at from 80° to 100° C. and the product to be used according to the invention is then added and dyeing is carried out at from 80° to 95° C.

The conventional anionic dyes may be used for dyeing the natural polyamides (i.e. wool) and/or the nylon fibers according to the invention. These dyes are nonmetallized dyes containing sulfo groups, as well as metal complex dyes whch may or may not contain sulfo groups. Suitable dyes are commercially available and are listed in the Color Index.

When carrying out the process according to the invention, the conventional dyeing assistants, eg. oxyethylated amines, oxyethylated fatty alcohols, oxyethylated castor oil and anionic products possessing affinity for the fibers, eg. alkali metal salts or amine salts of alkylbenzenesulfonic acids, highly sulfonated castor oil or sulfonated oleic acid butylamide, may be added in the conventional amounts.

The textile goods can be dyed in the conventional manner, for example by starting at room temperature, then heating the liquor to the dyeing temperature, ie. to 80°-110° C., and allowing the dyes to be absorbed at this temperature. Pure wool is in general dyed at up to 105° C. whilst nylon fibers can be dyed at up to 110° C. The temperature of the liquor can be raised very rapidly because, in this stage of the dyeing process, the dyes are not yet being absorbed since the pH is above 7. As a rule, the procedure followed is to bring the pH to a value from 7 to 9 by adding alkali, eg. ammonia or sodium hydroxide solution.

In many cases, however, it is more advantageous to start the dyeing process with a hot liquor which as yet does not contain a pH regulator according to the invention. The reason for this is that it is much more advantageous to heat the liquor by using the waste heat of spent dyeing liquors in a separate unit or in a special apparatus for preparing warm water. The ester to be used as a pH regulator according to the invention is only introduced into the liquor when the latter already contains the goods to be dyed, the dyes and any dyeing assistants.

The process according to the invention has particular advantages for dyeing wool which has been provided with an anti-felting surface finish by means of special commercial synthetic resins. Examples of the latter are polyamide-epichlorohydrin resins according to German Pat. No. 1,177,824 or prepolymers having reactive groups, eg. isocyanates or carbamyl-sulfonates. This synthetic resin finish is intended to prevent the wool from felting when washed in a washing machine. However, these synthetic resin films on the surface of the wool have a particularly high affinity for anionic dyes. The latter are therefore absorbed very rapidly on the fibers, so that in most cases very uneven dyeings result. Using the process according to the invention it is very easy to produce particularly level dyeings of such wool carrying an anti-felting finish. The procedure followed is to add the dyes to the liquor at a pH of from about 8 to 9, introduce the textile goods, add the ester to be used as pH regulator according to the invention and then dye the goods in the conventional manner. As a result of the pH control, the anionic dyes are absorbed slowly and evenly on the wool fibers carrying the anti-felting finish. Furthermore, excellent exhaustion of the bath is achieved.

Using this process, wool textiles which carry an anti-felting finish and have already been made up into garments can by dyed evenly in a suitable dyeing machine, for example a paddle vat. Using the conventional dyeing processes, this approach gives great problems in achieving dye uniformity, since the material, which is most cases is very densely knitted or woven, makes access of the dyeing liquor difficult. A further factor is the high affinity of such goods for the dye, as referred to above, which in any case makes it difficult to achieve level dyeing by means of the conventional dyeing processes.

The process according to the invention permits particularly streamlined operation. The textiles, at least those consisting of wool carrying an anti-felting finish, can be made up into garments before dyeing and can then be dyed quickly—in accordance with customer requirements—in the desired shades. Hitherto, such textiles have been produced from dyed yarns, so that orders have had to be placed much earlier, and difficult-to-sell stocks in various shades were often left which had to be disposed of at a loss.

1,000 parts by weight of the liquor as a rule contain from 0.001 to 10 parts by weight of one or more anionic dyes, from 0.1 to 5 parts by weight of any conventional dyeing assistants which may be used, and from 0.2 to 5, preferably from 0.5 to 2, parts by weight of one or more esters, to be employed according to the invention, as the pH regulator.

The Examples which follow illustrate the invention. In the Examples, parts are by weight.

Dyeing Method:

Wool or nylon fabric samples of size 10×30 cm were dyed with anionic dyes specified in more detail in the individual Examples. Initially, sufficient ammonia solution was added to the dyeing liquor to give a pH of 8. The dyes were added at room temperature and the liquor was then heated. The material to be dyed was introduced into the liquor at 80° C. Thereafter, in parallel experiments, 1 part of one of the products A to E was added to 1,000 parts of the dyeing liquor at the boil. The products had the following composition:

Product (A): triethanolamine triacetate (according to the invention)

Product (B): ethyl lactate (according to British Pat. No. 716,990)

Product (C): dimethyl succinate (according to British Pat. No. 716,990)

Product (D): the mono-ester obtained from 2 moles of glycol and 1 mole of glutaric acid (according to German Laid-Open Application DOS 2,542,926) and Product (E): butyrolactone (according to German Laid-Open Application DOS 2,354,728).

EXAMPLE 3

Dyeing on wool; 4.5% of the metal complex dye of 1 gram atom of chromium and 2 moles of the dye CI 15,710.

EXAMPLE 4

Dyeing on wool; 3% of the dye CI 17,070.

EXAMPLE 5

Dyeing on wool; 2.7% of the dye CI 62,125.

EXAMPLE 6

Dyeing on wool; 1.8% of the dye CI 18,690.

EXAMPLE 7

Dyeing on fibers of a linear nylon obtained from hexamethylenediamine and adipic acid; 2.7% of the dye CI 17,070.

EXAMPLE 8

Dyeing on fibers of a linear nylon obtained from hexamethylenediamine and adipic acid; 2.7% of the dye CI 62,125.

EXAMPLE 9

Dyeing on fibers of a linear nylon obtained from hexamethylenediamine and adipic acid; 1.2% of the dye CI 18,690.

TABLE

| | Dye content of the liquor after completion of the dyeing process, in %, as a function of the pH regulator employed | | | | | | | | |
|---|---|---|---|---|---|---|---|---|---|
| pH regulator | Example 1 | Example 2 | Example 3 | Example 4 | Example 5 | Example 6 | Example 7 | Example 8 | Example 9 |
| Product A | 0.5 | 0.6 | 1.4 | 6.7 | 2.3 | 4.4 | 3.6 | 15.6 | 4.7 |
| Product B | 1.25 | 1.9 | 3.8 | 9.7 | 4.2 | 8.5 | 8.9 | 18.2 | 7.2 |
| Product C | 2.8 | 4.5 | 13.8 | 13.1 | 8.7 | 6.4 | 16.6 | 17.7 | 7.1 |
| Product D | 1.6 | 4.0 | 6.8 | 12.1 | 6.3 | 6.9 | 17.8 | 23.2 | 5.7 |
| Product E | 0.8 | 0.9 | 2.7 | 8.1 | 2.7 | 6.9 | 7.5 | 18.1 | 4.9 |

The fabric was dyed for 1½ hours at the boil and the pH of the liquor was measured at the beginning and end of the dyeing process. Furthermore, the dye concentration in the liquor after dyeing was determined photometrically and expressed as a percentage of the dye concentration in the liquor before dyeing.

The results shown in Examples 1 to 9 (compare the list in the Table) show clearly that the use of triethanolamine triacetate, according to the invention, in each case gives the best color yield, ie. the lowest dye concentration in the residual liquor after dyeing.

The dyes are commercial products. The percentages quoted for the dyes employed are based on the goods to be dyed. The designation of the dyes is as given in the Color Index (CI).

EXAMPLE 1

Dyeing on wool; 1.6% of a metal complex dye of 1 gram atom of chromium and 1 mole each of the dyes CI 15,710 and CI 18,744.

EXAMPLE 2

Dyeing on wool; 2.5% of the dye CI 15,707.

EXAMPLE 10

Dyeing on wool carrying an anti-felting finish 100 parts of wool yarn provided with an anti-felting finish of a polyamide-epichlorohydrin resin according to German Pat. No. 1,177,824, in cheese form, are introduced into 1,000 parts of water which has been brought to a pH of 8.5 by adding ammonia solution. 1 part of the dye CI 15,707, 0.5 parts of an adduct of 12 moles of ethylene oxide with 1 mole of oleylamine and 1 part of triethanolamine triacetate are then added. Dyeing is started at 35° C., the liquor is heated to the boil in the course of half an hour, and the wool is dyed at this temperature for 1½ hours. A blue, outstandingly level dyeing is obtained. The dyeing liquor is exhausted completely.

Using a similar method, very level dyeings, with excellent exhaustion of the liquor, are obtained if instead of the triethanolamine triacetate the following compounds are used, at the same concentration:

1. The tetraacetate of the reaction product of 4 moles of ethylene oxide with ethylenediamine 2. The pentaacetate of the reaction product of diethylenetriamine with 5 moles of ethylene oxide and

3.

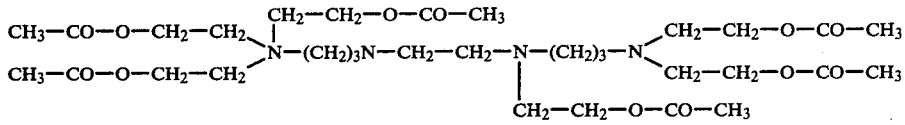

We claim:

1. A process for dyeing a textile material consisting of wool and/or of nylon fibers with an anionic dye in an aqueous liquor at up to 110° C., wherein dyeing is commenced at a pH of from 7 to 9 and from 0.2 to 5 parts by weight, per 1,000 parts by weight of liquor, of an ester of a saturated $C_2$–$C_4$-carboxylic acid with an alcohol having a tertiary amino group in the 2-position to a hydroxy group are then added to act as a pH regulator.

2. The process of claim 1, wherein the pH regulator used is the triester of a saturated $C_2$–$C_4$-carboxylic acid with triethanolamine or with the compound of the formula

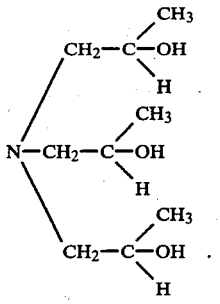

3. The process of claim 1, wherein the pH regulator used is the tetraacetate of the reaction product of 4 moles of ethylene oxide with ethylenediamine, the pentaacetate of the reaction product of diethylenetriamine with 5 moles of ethylene oxide, or the compound of the formula

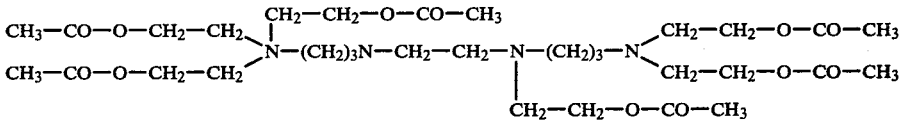

4. The process of claim 1, wherein the pH regulator used is triethanolamine triacetate.

5. The process of claim 1, wherein the textile material is introduced into a dye-containing liquor which is at 80° to 100° C. and has a pH of from 7 to 9, the pH regulator is then added, and dyeing is carried out at from 80° to 95° C.

6. The process of claim 1, wherein the textile material dyed is wool which has an anti-felting surface finish.

7. The process of claim 1, wherein the textile material which is dyed is a wool or nylon velour.

* * * * *